US007334840B2

(12) United States Patent
Deans et al.

(10) Patent No.: US 7,334,840 B2
(45) Date of Patent: Feb. 26, 2008

(54) GLIDER CHAIR WITH SELF-LOCKING MECHANISM

(75) Inventors: Rob Deans, Ontario (CA); Tony Purkis, Ontario (CA); Takuro Nishiwaki, Ontario (CA)

(73) Assignee: Broda Enterprises Inc., Waterloo, Ontario (CA)

( * ) Notice: Subject to any disclaimer, the term of this patent is extended or adjusted under 35 U.S.C. 154(b) by 17 days.

(21) Appl. No.: 11/226,079

(22) Filed: Sep. 13, 2005

(65) Prior Publication Data

US 2006/0061164 A1 Mar. 23, 2006

Related U.S. Application Data

(60) Provisional application No. 60/610,158, filed on Sep. 14, 2004.

(51) Int. Cl.
*A47C 3/03* (2006.01)

(52) U.S. Cl. ..... 297/270.1; 297/273; 297/281

(58) Field of Classification Search ..... 297/273, 297/281, 282, 270.1, 270.2
See application file for complete search history.

(56) References Cited

U.S. PATENT DOCUMENTS

| | | | | |
|---|---|---|---|---|
| 4,320,818 | A | 3/1982 | Knoche | |
| 4,438,973 | A | 3/1984 | La Pointe | |
| 4,623,043 | A | 11/1986 | Babilas | |
| 4,790,598 | A * | 12/1988 | Locher | 297/302.2 |
| 5,203,433 | A | 4/1993 | Dugas | |
| 5,947,557 | A * | 9/1999 | Bellefleur | 297/281 |
| 6,120,094 | A | 9/2000 | Parent | |
| 6,244,658 | B1 * | 6/2001 | Parent et al. | 297/270.1 |
| 6,406,095 | B1 | 6/2002 | Bouchard et al. | |
| 6,464,295 | B1 | 10/2002 | Bergeron et al. | |
| 6,588,841 | B1 | 7/2003 | Hoffman et al. | |
| 6,612,651 | B1 * | 9/2003 | Garland | 297/344.11 |
| 6,761,405 | B2 | 7/2004 | Bellefleur | |
| 2005/0062322 | A1 * | 3/2005 | Guillot et al. | 297/270.1 |

* cited by examiner

*Primary Examiner*—Sarah B. McPartlin
(74) *Attorney, Agent, or Firm*—Thorpe North & Western, LLP

(57) ABSTRACT

A glider chair includes a glider frame and a seat, swingably suspended by a plurality of hangers from a base disposable on a support surface. The seat is pivotable with respect to the glider frame between an upper position and a lower position, and biased to the upper position. An automatic locking mechanism is coupled between the seat and at least one of the plurality of hangers. The automatic locking mechanism moves as the seat pivots to engage the at least one of the plurality of hangers to resist motion of the glider frame relative to the base when the seat is in the upper position.

13 Claims, 8 Drawing Sheets

GLIDER CHAIR WITH SELF-LOCKING MECHANISM

Benefit is claimed of U.S. Provisional Patent Application Ser. No. 60/610,158, filed Sep. 14, 2004.

FIELD OF THE INVENTION

The present invention relates generally to glider rocking chairs, and more particularly to a glider rocking chair with a self-locking mechanism.

BACKGROUND OF THE INVENTION

Rocking chairs have been popular since the early $17^{th}$ century. Besides the soothing rocking motion, rockers have been ideal for reading, knitting, sewing, and other seated tasks. From the beginning, rocking chairs have had problems which have driven inventors to make improvements. In fact, rockers were first known as "carpet cutters" because of the damage done to carpets by repeated rocking in the same place. Additionally, rockers were deemed too plain for the formal parlor, and so early chairs were consigned mostly to porches. Because of these and other problems, improvements to the rocking chair were almost immediately sought and innovations continue today.

One of the most recent innovations to the rocking chair concept is the glider chair. Glider chairs, similar to rocking chairs, provide a soothing repetitive rocking type motion, but unlike rocking chairs, they do not wear through carpet from repeated rocking in the same place. Typically, a glider chair consists of a base coupled to a seat in such a way as to allow the seat to swing forward and backward while the base remains stationary. Parallel arms pivotally connected to the base and seat are commonly used to achieve the desired swinging motion of the seat. Sometimes a glider chair will have an intermediate movable portion between the seat and the base so that when the chair is actively gliding the seat remains in a relatively horizontal position with respect to the base. In this case, parallel arms would extend between the intermediate movable portion and the base.

Because the glider chair seat moves freely, the force a person exerts on the seat when entering or exiting the chair easily moves the seat, causing an unstable support for a person attempting to rise from, or sit in, the glider chair. This motion makes it very difficult for elderly or disabled persons who rely on arm strength to enter or egress a chair to sit in traditional glider chairs. Additionally, it is difficult to move a glider chair because the glider portion will move some distance before actually moving the base of the chair.

To address this problem, locking mechanisms for glider chairs have been employed to lock the chair and prevent movement unless unlocked. These locks may be automatic so that when a person is in the chair, it is free to move, but automatically locks when the chair is unoccupied. Additionally, the lock may be a combination of an automatic lock and manual lock, such that the chair may be manually locked when the chair is occupied or unoccupied, but will also lock automatically when unoccupied if the manual lock is not engaged.

Typical automatic locking devices for glider chairs often have engagement problems. Some of these engagement problems are the result of multiple moving parts that are indirectly locked against the stationary base. Other engagement issues occur because the seats on glider chairs are easily mispositioned with respect to the locking device when the occupant leaves the chair, thereby causing lock engagement failures, and allowing the chair to slip suddenly and unexpectedly. External forces are applied to a chair can also cause lock engagement problems because the magnitude or direction of some external forces can overcome the securing forces of the locking device and allow the chair to slip out of the lock.

SUMMARY OF THE INVENTION

It has been recognized that it would be advantageous to develop a glider chair with an automatic locking mechanism that will engage the moving parts of the chair to more securely restrict motion of the chair. It has also been recognized that it would be advantageous to develop a glider chair with an automatic locking mechanism that will engage even when the seat is mispositioned relative to the locking mechanism upon egress of an occupant, or when external forces are applied to a locked, unoccupied chair. It has also been recognized that it would be advantageous to develop a glider chair with a centrally located automatic locking mechanism to more evenly distribute the locking forces on the moving parts of the chair.

The invention advantageously provides a glider chair including a glider frame and a seat, swingably suspended by a plurality of hangers from a base disposable on a support surface. The glider frame and seat can swing fore and aft relative to the base. The seat can be pivotable with respect to the glider frame between an upper position and a lower position. The seat can be biased to the upper position. An automatic locking mechanism can be coupled along a centerline of the chair between the seat and at least one of the plurality of hangers. The automatic locking mechanism can move as the seat pivots, and can engage the at least one of the plurality of hangers to resist motion of the glider frame relative to the base when the seat is in the upper position. The automatic locking mechanism can disengage from the at least one of the plurality of hangers to allow motion of the glider frame relative to the base when the seat is in the lower position.

In another aspect, the present invention provides for a glider chair including a glider frame and a seat, swingably suspended by a plurality of hangers from a base disposable on a support surface. The glider frame and seat can swing fore and aft relative to the base. The seat can be pivotable with respect to the glider frame between an upper position and a lower position. The seat can be biased to the upper position. A rod can be coupled to at least one of the plurality of hangers. An automatic locking mechanism can be coupled between the seat and the glider frame, and can include a toothed bar with a plurality of teeth having nonsymmetrical profile providing at least one notch to receive the rod and position the glider frame in at least one preferred position with respect to the base. Motion of the glider frame relative to the base can be restricted when the rod is received in the notch.

The present invention also provides for a method of locking a glider chair against glider motion when an occupant arises from the seat including providing a glider chair having a glider frame and seat swingably suspended by a plurality of hangers from a base disposable on a support surface. The glider frame and seat can swing fore and aft relative to the base. The seat can be biased toward an upper position when unoccupied. An automatic locking mechanism can be engaged between the glider frame and the plurality of hangers when the seat is in the upper position.

Additional features and advantages of the invention will be apparent from the detailed description which follows, taken in conjunction with the accompanying drawings, which together illustrate, by way of example, features of the invention.

DETAILED DESCRIPTION

Figure 1:
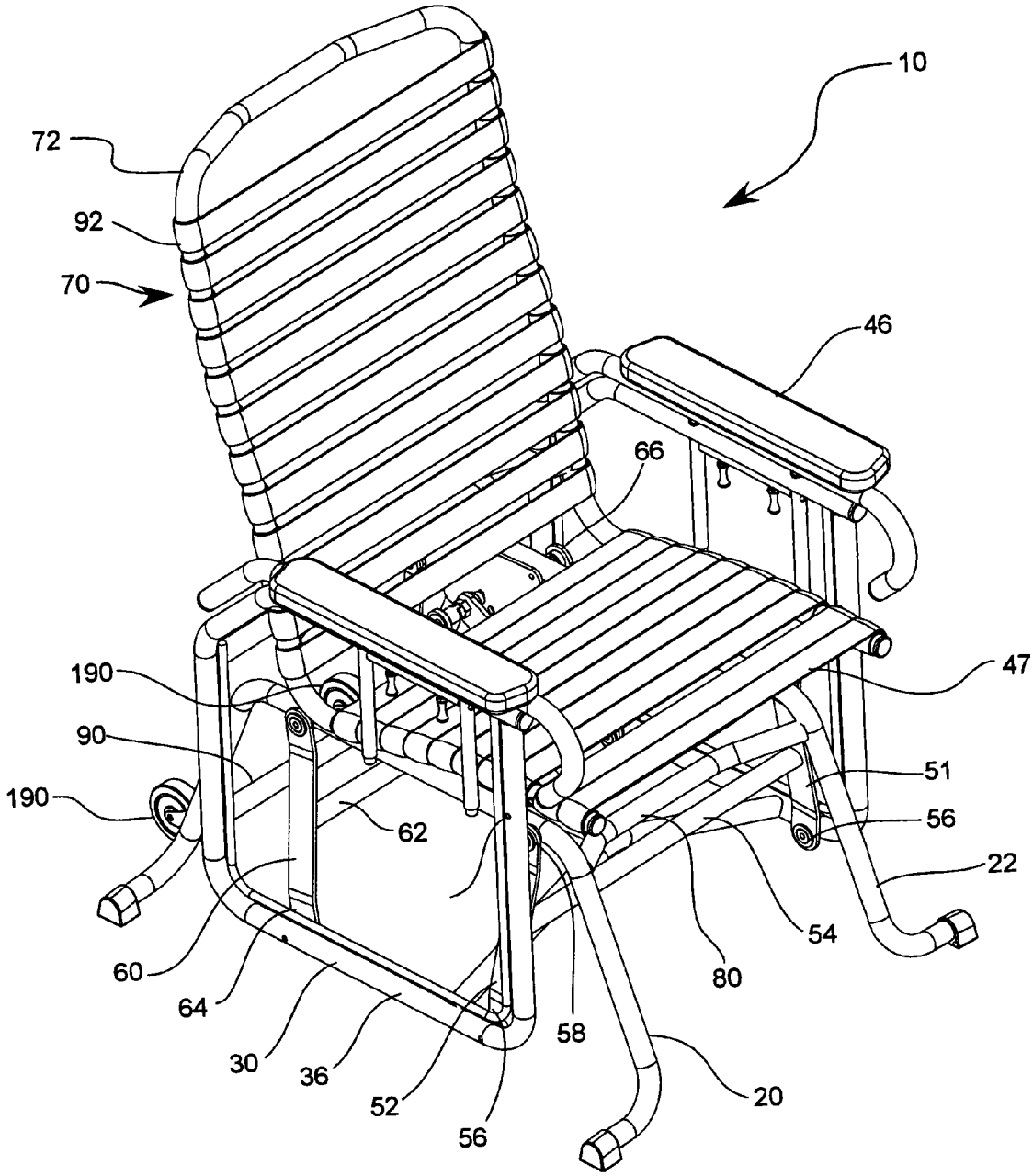
FIG. 1 is a perspective view of a glider chair in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention is directed to a glider chair having an automatic locking mechanism. The automatic locking mechanism engages when the seat is unoccupied so that the seat will not rock or glide. The lock disengages under the weight of an occupant when the chair is occupied so that the seat can freely rock or glide. The chair can also include a manual locking device that can be engaged when the chair is either occupied or unoccupied, to prevent the chair from moving. Unlike other glider chairs with an automatic locking device, the automatic locking mechanism of the present invention interconnects the seat with the hangers that suspend the glider frame from the stationary base, rather than directly with the stationary base.

Figure 2:
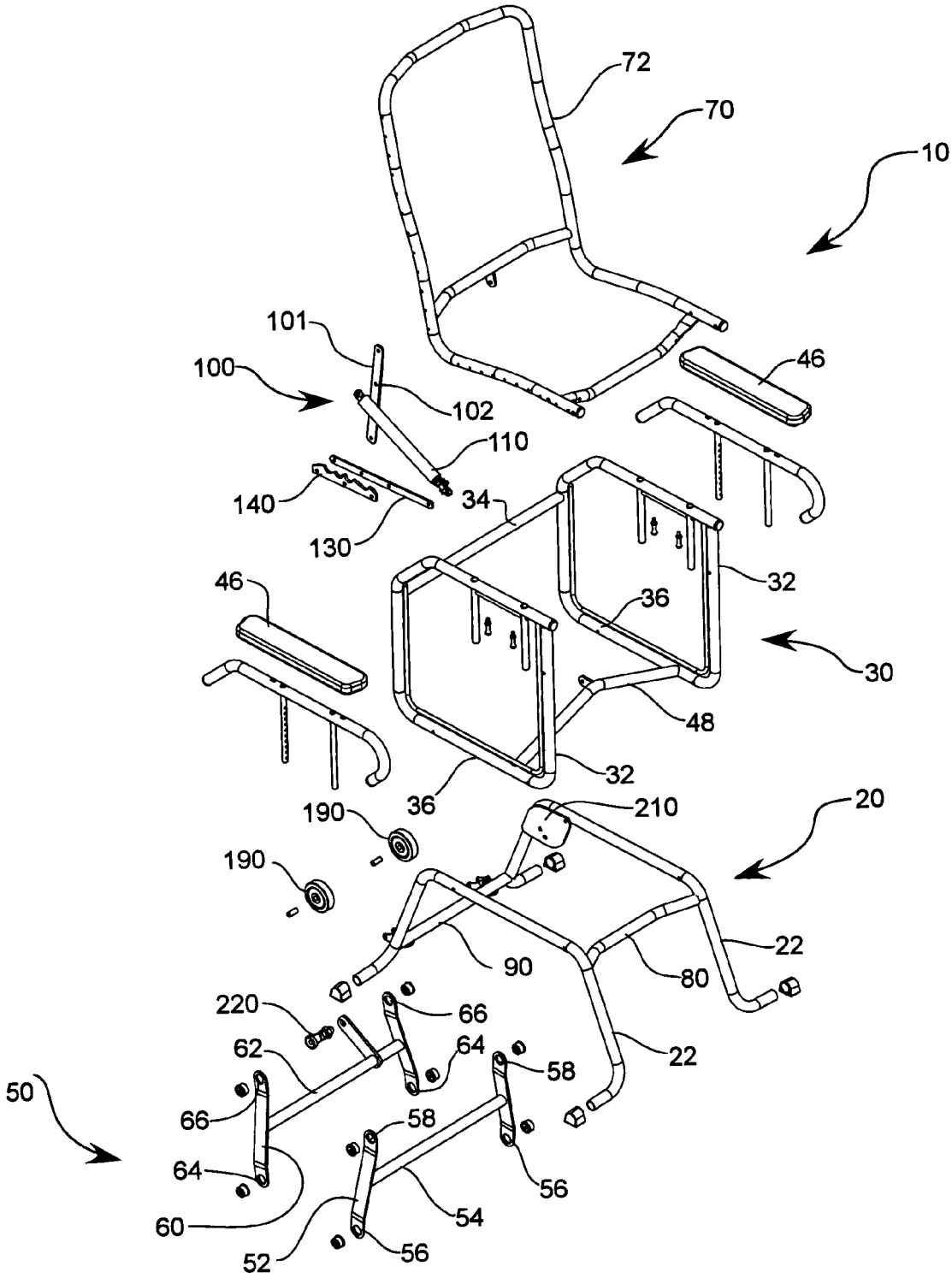
FIG. 2 is an perspective exploded assembly view of the glider chair of FIG. 1.
Figure 3:
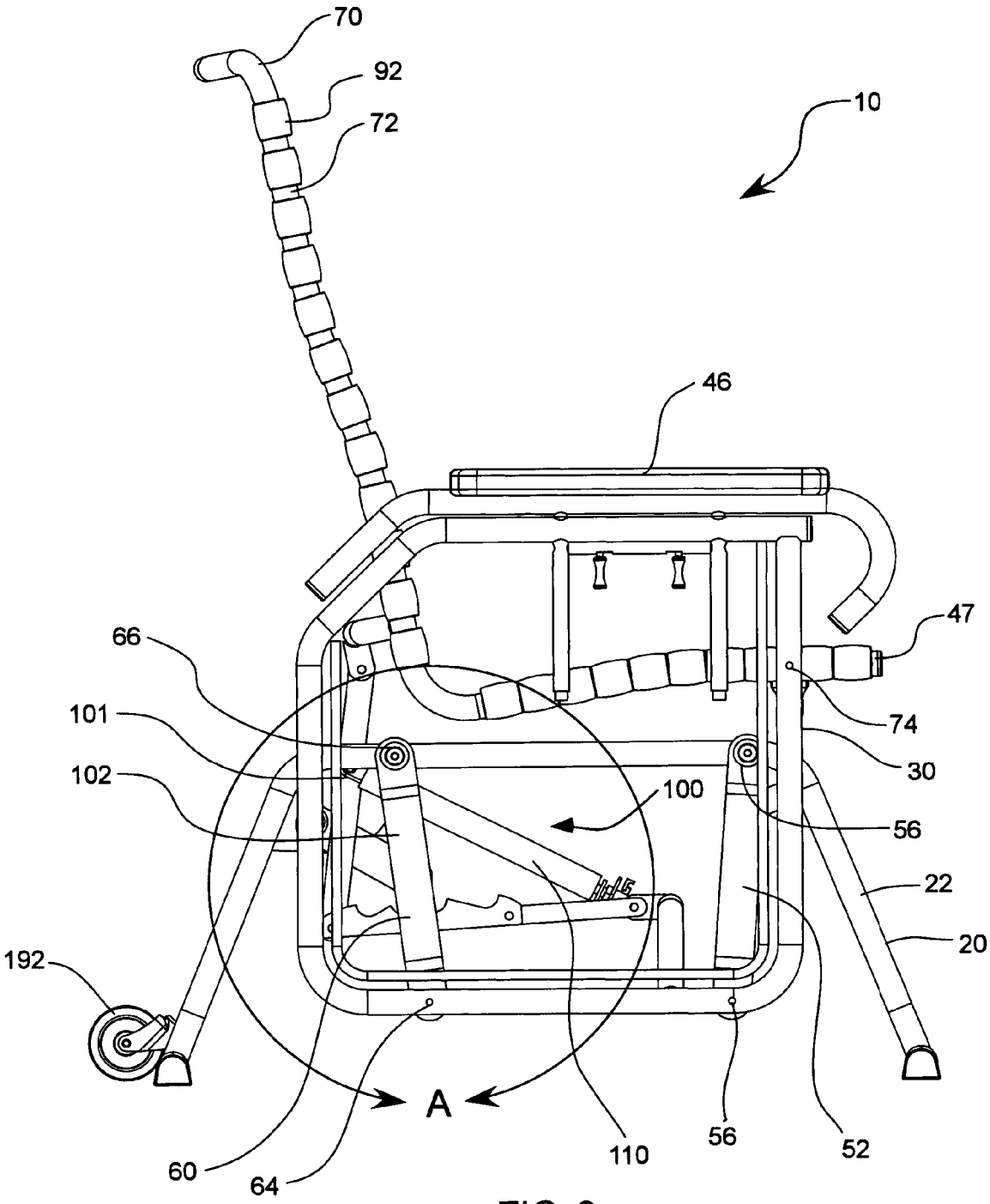
FIG. 3 is a side view of the glider chair frame of FIG. 1 in an occupied and unlocked configuration.

As illustrated in FIGS. 1-3, a self-locking glider chair, indicated generally at 10, in accordance with the present invention is shown. The chair can include a base 20, a glider frame 30 moveably connected to the base 20, and a plurality of hangers 50 located on each side of the chair 10. A seat 70 can be pivotally connected to the glider frame 30 by a pivot 74 near the front of the seat 70 and the glider frame 30. Thus, the glider frame 30 and the seat can be suspended above the base 20 by the plurality of hangers 50 and can swing fore and aft relative to the base 20.

The base 20 can include a pair of support members 22 oriented parallel to each other, and spaced apart the approximate width of the chair 10. The support members 22 can extend to a height that will allow the seat 70 to be suspended over the base 20 by the glider frame 30 in a comfortable, natural seating position. The support members 22 can be connected together by front base cross member 80 and rear base cross member 90 that keep the base 20 stable. Wheels 190 can be attached to the rear base cross member 90 so that when the chair 10 is unoccupied and locked, the chair can be tipped backward onto the wheels 190 in order to easily move the entire chair 10.

In one aspect, the support members 22 can be made of a single section of round or square tube that is bent at the appropriate locations as illustrated in FIGS. 1 and 2. In another aspect, they could be made of several individual sections joined together by fasteners as known in the art.

The glider frame 30 can include a pair of spaced apart side frames 32 parallel to one another and interconnected by a front glider frame cross member 48 and a rear glider frame cross member 34. The cross members 48 and 34 can extend across the base 20 traversing the glider chair 10, and keep the glider frame 30 stable. The side frames 32 can be spaced apart wider than the seat 70 and the base 20, and can enclose both the seat 70 and the base 20 between the side frames 32. Each side frame 32 can include an armrest 46.

It will be appreciated that, like the base 20, the side frames 32 can be made of a single section of round or square tube that is bent at the appropriate locations, or they can be made of several individual sections joined together by fasteners known in the art. Additionally, the side frames 32 can have a polygonal shape as illustrated, or be shaped as a circle, oval or other suitable shape.

The glider frame 30 can be moveably connected to the base 20 by the plurality of hangers 50 located on each side of the chair 10. The plurality of hangers 50 can include a pair of front hangers 52 located closer to the front of the chair 10, and connected together by a front hanger cross member 54. The front hanger cross member 54 can traverse the base 20 and can space the front hangers 52 apart to allow the front hangers 52 to freely swing about the base 20. The bottom ends 56 of the front hangers 52 can be moveably connected to the bottom 36 of the glider frame 30. The top ends 58 of the front hangers 50 can be moveably connected to the base 20.

The plurality of hangers 50 can also include a pair of rear hangers 60 than can be located closer to the back of the chair 10, and connected together by a rear hanger cross member 62. The rear hanger cross member 62 can be a rod, as shown in FIGS. 1-2. The rear hanger cross member 62 can traverse the base 20, and space the rear hangers apart to allow the rear hangers 60 to freely swing about the base 20. The rear cross member 62 can be positioned between the rear hangers 60 and can form a portion of the automatic locking mechanism 100. The rear hanger cross member can also function as an index bar for the automatic locking mechanism 100. The bottom ends 64 of the rear hangers 60 can be moveably connected to the bottom 36 of the glider frame 30. The top ends 66 of the rear hangers can be moveably connected to the top 28 of the base 20.

The plurality of hangers 50 can be of a length that will suspend the glider frame 30 from the base 20 and allow the glider frame 30 and attached seat 70 to swing forward and backward with respect to the base 20. The plurality of hangers 50 can be located outside the base 20 and inside the glider frame 30 such that the pair of front hangers 52 and the pair rear hangers 60 are free to swing without interference from the base 20 or the glider frame 30.

The seat 70 can include a frame 72 and a cover material 92 attached to the frame 72. The seat 70 can have a pivot 74 near the front of the glider frame 30 and the front of the seat 70. This pivot 74 can allow the back of the seat 70 to raise and lower between an upper position and a lower position with respect to the base 20 and the glider frame 30. The seat 70 can be biased to the upper position by a biasing device 110, such as a gas spring cylinder, which will be discussed in greater detail below.

Figure 4:
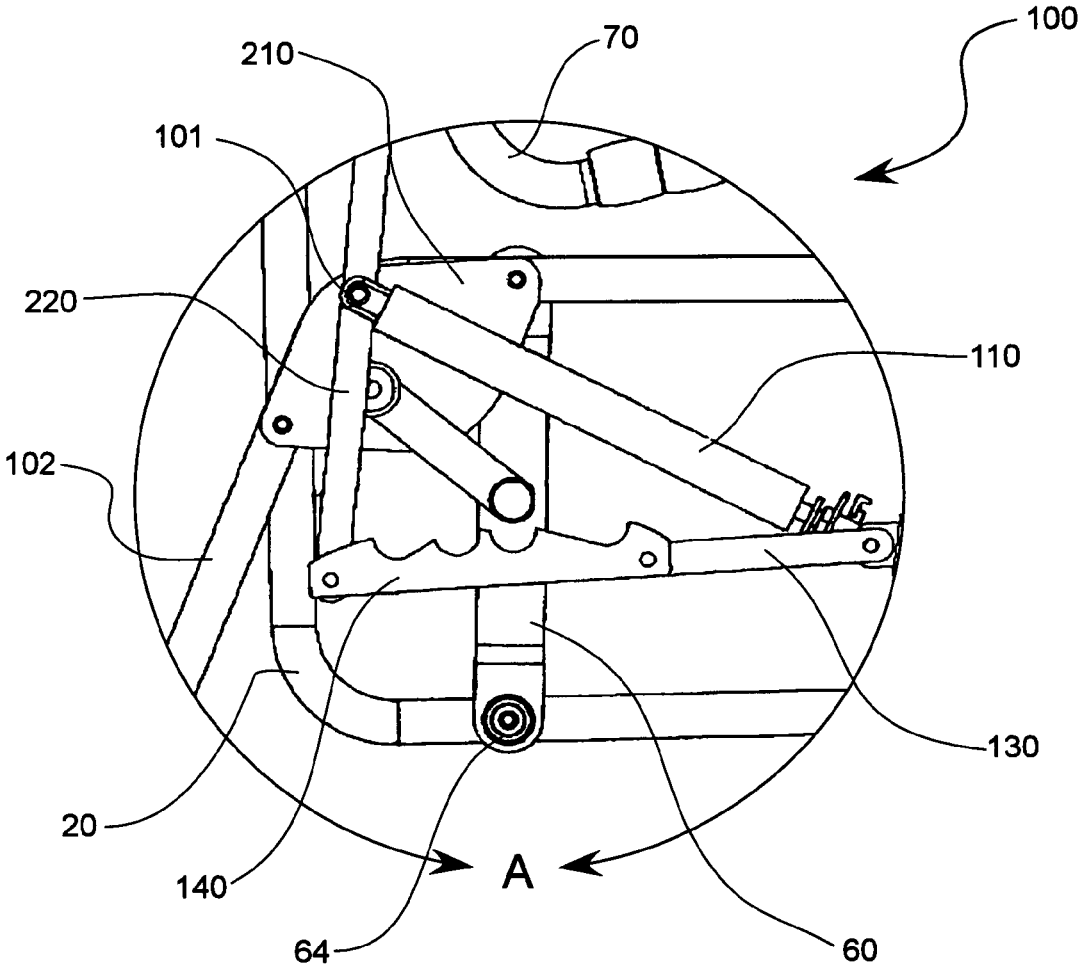
FIG. 4 is a magnified view of cut away section A of FIG. 3 showing an automatic locking mechanism in an unlocked configuration.

As shown in FIGS. 2-4, the glider chair 10 can have an automatic locking mechanism 100. The automatic locking mechanism can lock the glider frame 30 against at least one of the plurality of hangers 50. Advantageously, locking the glider frame 30 against at least one of the plurality of hangers 50 positively locks both the swingable components of the chair 10, and does not rely on immobilizing one of the moving components by locking a different movable component as has been typical with other glider chair automatic locking devices. The automatic locking mechanism 100 is an example of one means for locking the glider frame 30 against the plurality of hangers 50 to restrict undesirable motion when an occupant sits or rises from the glider chair 10.

The automatic locking mechanism 100 can have a linkage 102 moveably coupled to the seat 70 and a toothed bar 140 pivotally coupled to the linkage 102. The biasing device 110 can be moveably coupled between the linkage 102 and the glider frame 30. As shown in the magnified view of FIG. 4, the toothed bar 140 can be coupled to a toothed bar linkage 130. The toothed bar linkage 130 can be pivotally coupled between the front glider frame cross member 48 and the linkage 102. Similarly, the biasing device 110 can be pivotally connected between the front glider frame cross member 48 and an intermediate location 101 on the linkage 102, thereby creating a three bar linkage between the linkage 102, the biasing device, and the toothed bar linkage 130.

Thus, in use, the biasing device 110 can bias the seat 70 toward an upper position through the linkage 102. When in the upper position the linkage 102 pulls the toothed bar linkage 130 into an upper position so that the toothed bar 140 engages the rear hanger cross member 62 in the toothed bar 140, thereby preventing forward and backward motion by the glider frame 30. When the glider chair 10 is occupied, the weight of the occupant on the seat 70 acts through the linkage 102 as a downward force on the biasing device 110, consequently moving the seat 70 into a lower position. When the seat 70 is lowered, the linkage 102 moves the toothed bar linkage 130 into a lower position, causing the toothed bar 140 to disengage the rear hanger cross member 62, thereby allowing the glider frame 30 to move forward and backward with respect to the base 20.

In this way, the rear hanger cross member 62 functionally acts an indexing bar for the automatic locking mechanism 100. Use of the rear hanger cross member 62 as the indexing bar in the automatic locking mechanism 100 provides the advantage of engaging the automatic locking mechanism 100 to an intermediate location on least one of the plurality of hangers 50 and distributes the load from the toothed bar 140 across the moment arm formed by the hanger 60 which provides a more secure lock than coupling at the end of the hanger 60. Additionally, using the rear hanger cross member 62 as the indexing bar to the automatic locking mechanism 100 advantageously eliminates the need for additional hardware on the glider chair 10. It will be appreciated, however, that a separate rod could be coupled to an intermediate location of at least one of the plurality of hangers 50 and function as the indexing bar for the automatic locking mechanism 100.

In the present invention, the biasing device 110 can act as an actuator biasing the seat 70 into an upper locked position from a lower unlocked position. It will be appreciated that the actuator can be any positive force-exerting device, such as a gas spring cylinder, a compression spring, a leaf spring, or elastic banding, or the like.

Thus, the three bar linkage formed by the linkage 102, the biasing device 110, and the toothed bar linkage 130, as described above, functions as the automatic locking mechanism 100 for restricting motion of the glider frame 30 whenever an occupant rises from the seat 70. Specifically, the automatic locking mechanism 100 can move as the seat pivots to engage a rod coupled to at least one plurality of hangers 50 with the toothed bar 140 to resist motion of the glider frame 30 relative to the base 20 when the seat 70 is in an upper position, and to disengage from the at least one of the plurality 50 of hangers to allow motion of the glider frame 30 relative to the base 20 when the seat 70 is in a lower position.

Figure 5:
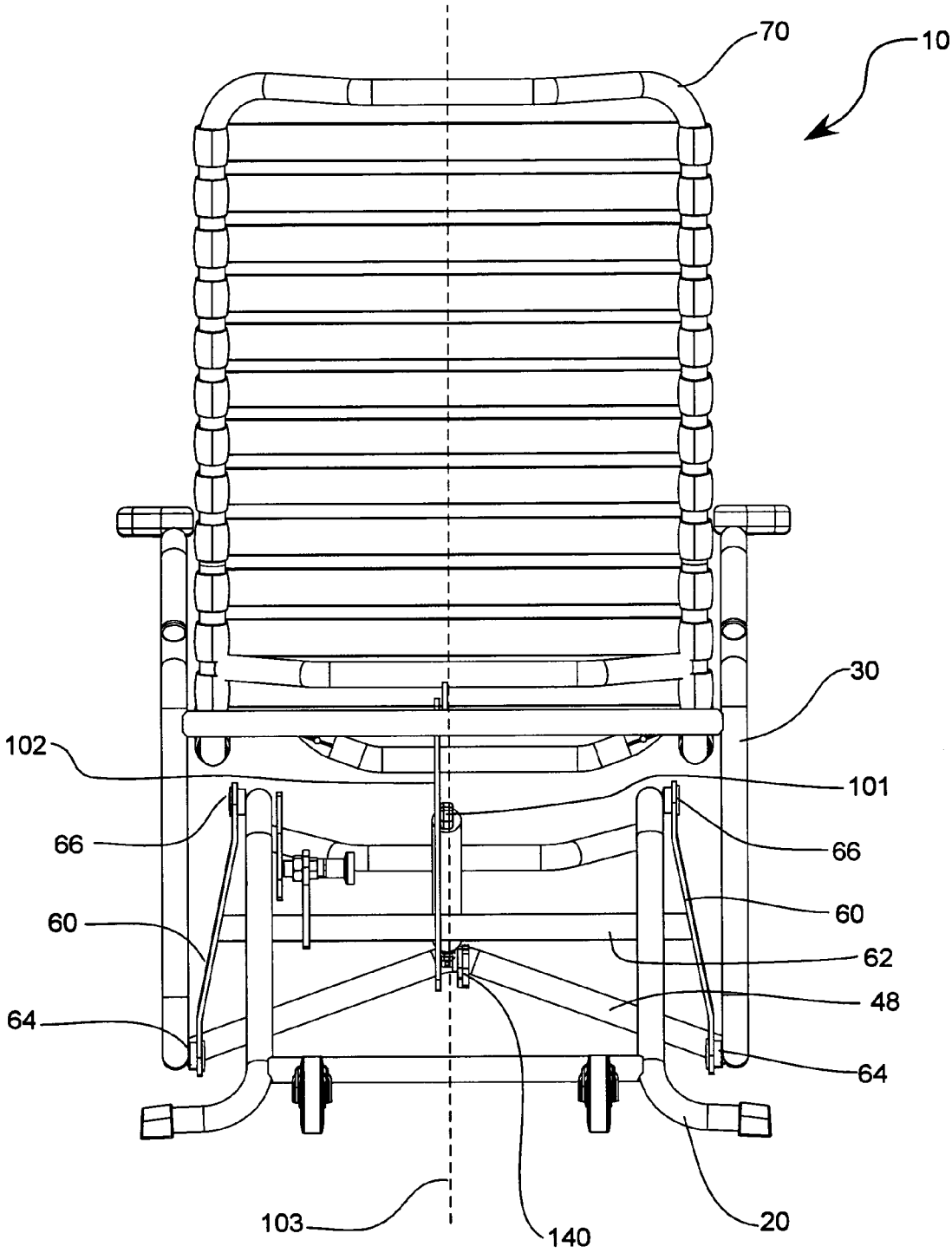
FIG. 5 is a rear view of the glider chair of FIG. 1.

Additionally, the automatic locking mechanism 100 can be positioned substantially along centerline 103, shown as a dashed line in FIG. 5, of the glider chair 10. Advantageously, positioning the automatic locking mechanism 100 substantially along the centerline of the chair stabilizes the seat 70 with respect to the glider frame, and minimizes twisting of the seat 70 as an occupant sits in or rises from the seat. Additionally, the forces from the biasing device 110 that bias the seat 70 to the upward position are more uniformly transferred across the seat frame 72. It will be appreciated that the linkages positioned toward one side of the chair or the other would distribute forces from the biasing device 110 mainly along the side of the seat 70 connected to the biasing device 110 and cause an out of balance effect on the seat 70, while the positioning of the present invention minimizes the out of balance effects of the biasing forces thereby providing a more comfortable and secure chair 10 for the occupant. Furthermore, positioning the automatic locking device along the centerline minimizes access to potential pinch points within the moving parts of the glider chair 10.

Figure 6:
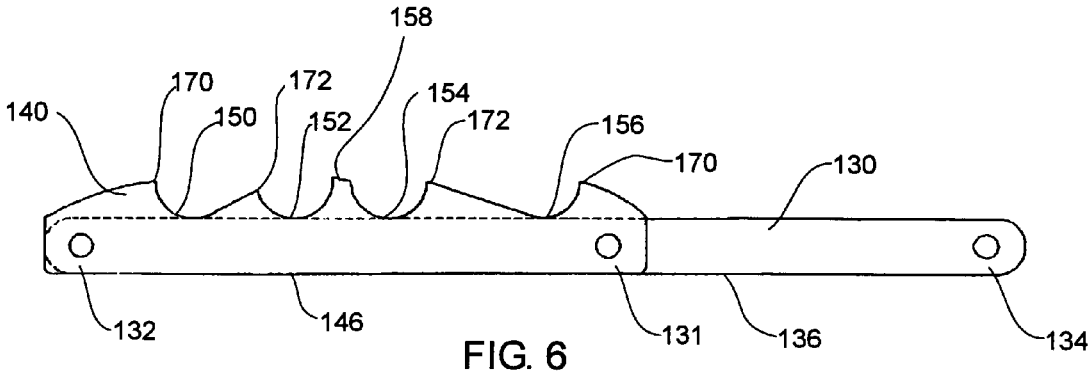
FIG. 6 is a side view of a toothed bar and a toothed bar linkage of the automatic locking mechanism of FIG. 4.
Figure 7:
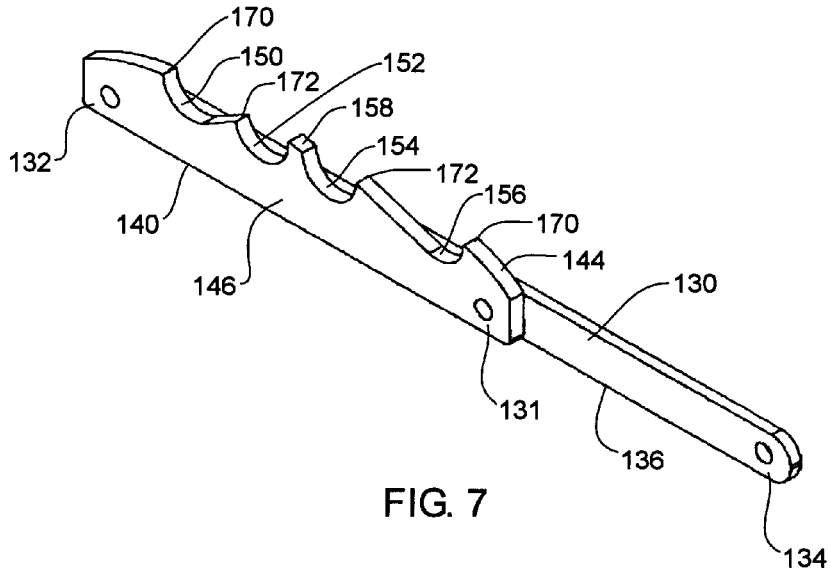
FIG. 7 is a perspective view of the toothed bar and toothed bar linkage of FIG. 6.

With respect to FIGS. 6 and 7, illustrated is the toothed bar linkage 130 of the automatic locking mechanism connected to the toothed bar 140. The toothed bar linkage 130 and the toothed bar 140 are both shown as flat plates having differing lengths and having two opposite ends. The toothed bar linkage 130 and the toothed bar 140 are connected at a rear common end 132. The toothed bar front end 142 is also connected to the toothed bar linkage 130 at an intermediate point 131 between the rear common end 132 and the toothed bar linkage front end 134. In this way, the toothed bar linkage 130 and the toothed bar 140 form a single member of the three bar linkage of the automatic locking mechanism 100, as described above.

The toothed bar 140 also can have a top side 144 and a bottom side 146. The bottom side 146 can have a substantially flat profile that is substantially parallel to the toothed bar linkage bottom side 136. The top side 144 of the toothed bar 140 can be generally curved, and can have a series of depressions, or notches, that form a nonsymmetrical profile such as a saw-tooth shape. More specifically, the saw-tooth shape of the top side 144 can include as notches a forward glide limit position 150, a first automatic locking position 152, a second automatic locking position 154 and a rearward glide limit position 156. It will be appreciated that the toothed bar 140 may include more locking positions, or fewer locking positions than illustrated herein.

The first and second automatic locking positions 152 and 154 can be substantially equal semi-circular cutouts in the profile of the top side 144. The forward and rearward glide limits 150 and 156 can also be semi-circular cutouts sized to receive the rear cross member 62, or indexing bar, in the top side 144 and the profile of the side of the forward glide 150 limit nearest the first automatic locking position 152 can slope upward toward the first automatic locking position 152 in order to bias the rear hanger cross member into the semi-circular cutout. In this way the glider frame 30 and seat 70, will move toward a center of the chair 10 upon egress of the occupant. Advantageously, this central position of the seat provides a more natural location for the armrests 46 and seat front 47 for an occupant during sitting or rising from the chair.

Similarly, the profile of the side of the rearward glide limit 156 nearest the second automatic locking position 154 can have a semi-circular portion and a sloped portion. The sloped portion can be sloped upward from the semi-circular portion toward the intermediate intersection point 172 in order to bias the rear hanger cross member 62 toward the semi-circular portion. The semi-circular portion can be configured to receive the rear hanger cross member 62, or indexing bar. Thus, as described above, the sloped portion can center the glider frame 30 and seat 70 if the occupant egresses the chair 10 with the glider frame 30 in a non central position with respect to the base 20.

An intermediate land 158 separates the forward glide limit position 150 and the first automatic locking position 152 from the second automatic locking position 154 and the backward glide limit position 156. The intermediate land 158 has a sloping profile to encourage engagement of the rear hanger cross member (shown as 62 in FIG. 1) into the second automatic locking position 154 upon egress from the chair by an occupant. The intermediate land 158 also has a higher profile than the intersections of the sloping portions of the forward and rearward glide limits 150 and 156 with the first and second automatic locking positions 152 and 154. Consequently, the toothed bar 140 can move more easily between the forward glide limit 150 and the first automatic locking position 152, or the rearward glide limit 156 and the second automatic locking position 154, than between the first and second automatic locking positions 152 and 154. Advantageously, the present invention moves the toothed bar 140 away from the indexing rod, as opposed to moving the indexing rod away from the toothed bar, which allows the toothed bar 140 to also act as a limit, or stop, to the gliding motion of the chair 10.

Similarly, the outer intersection points 170 of the forward glide limit 150 and the backward glide limit 156 with the general profile of the top side 148 are higher than the intermediate intersection points 172. The height of the outer intersection points prevents movement of the glider frame 30 beyond the position where the rear hanger cross member (shown as 62 in FIG. 1) engages either the forward or rearward glide limit when the glider chair 10 is unoccupied. Consequently, when the glider chair is unoccupied and locked, if enough force is exerted on the seat frame (shown as 70 in FIG. 1) to force the rear hanger cross member out of engagement with the first and second automatic locking positions 152 or 154 on the lock plate 140, then the rear hanger cross member will slide into either forward or rearward glide limit and be prevented from traveling any further. On the other hand, exerting force on the glider frame (shown as 30 in FIG. 1) should not force the rear hanger out of engagement with the automatic locking plate. Once the chair is in the locked position, the glider frame does not move substantially, even if a user pushes on it. This allows the chair to assist an occupant in getting into and out of the chair when the chair is locked.

Thus, in use, when an occupant stands up out of the glider chair 10 from a normal seating position, the biasing device 110 can raise the seat frame 70 and the linkage 102, which can pull the toothed bar linkage 130 upward. The toothed bar 140 can then engage the rear hanger cross member 62 and restrict the glider frame 30 from moving. If the rear hanger cross member 62 does not slip directly into the first or second locking position 152 or 154, but instead contacts the intermediate land 158, the rear hanger cross member 62 can slip off the reverse slope of the intermediate land 158 into the second automatic locking position 154.

On the other hand, if an occupant rises out of the glider chair 10 while in a forward or rearward rocking position, the toothed bar can engage the rear hanger cross member 62 in either the forward or rearward glide limit positions 150 or 156, respectively. Consequently, the glider chair 10 will be restricted from moving further forward or backward until the occupant is fully out of the chair. Additionally, the force from the biasing device 110 will tend to slide the rear hanger cross member 62 toward one of the first or second automatic locking positions 152 and 154 if an external force is applied to the glider frame 30 or seat 70 when the chair 10 is unoccupied but locked in either the forward or rearward glide limit position 150 or 156. In this way, the nonsymmetrical profile of the toothed bar 140 can position the glider frame 30 in at least one preferred position with respect to the base 20.

Figure 8:
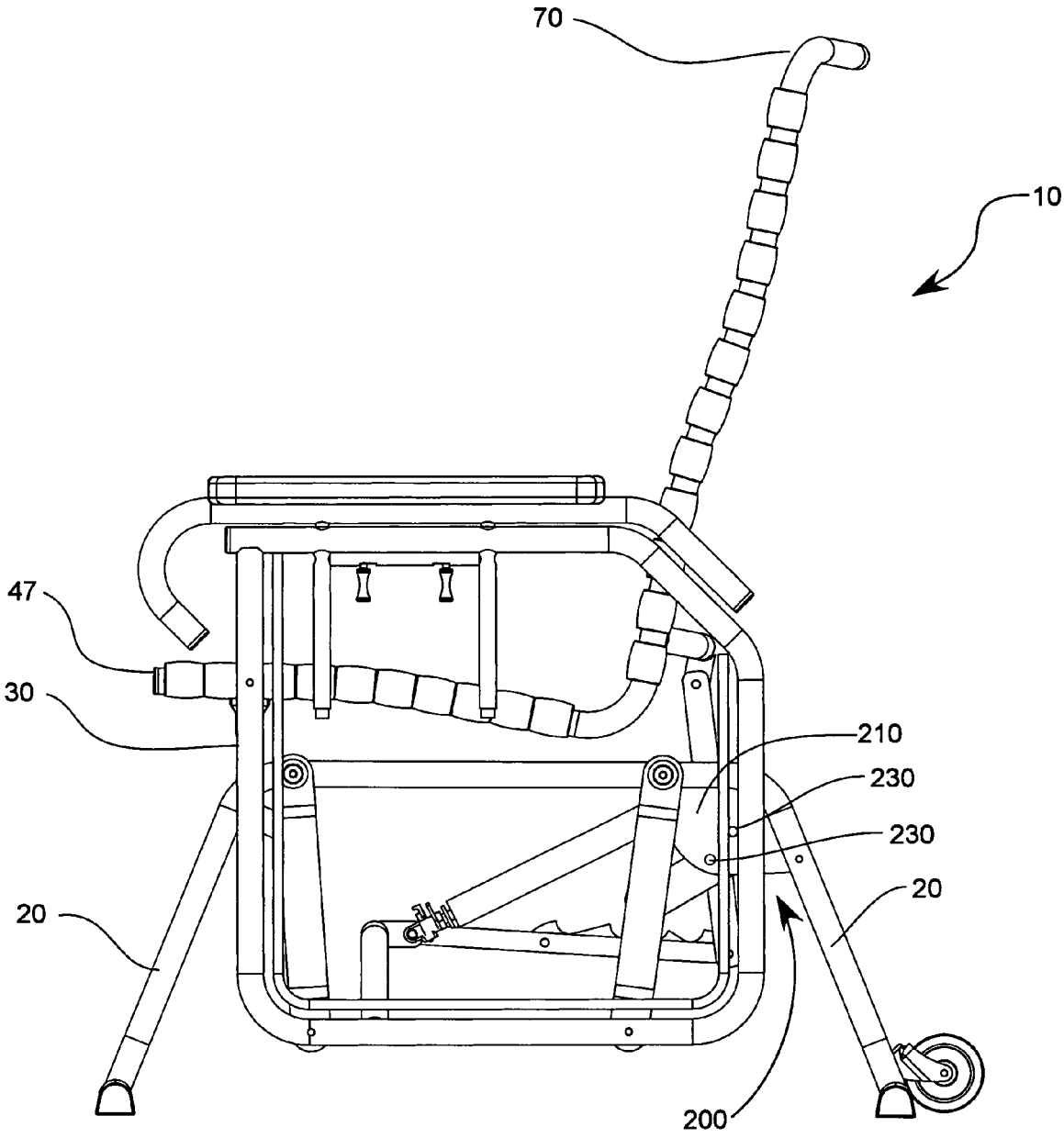
FIG. 8 is a side view of the glider chair frame of FIG. 1 showing a manual locking device.

With reference to FIG. 8, illustrated is a manual locking mechanism 200 selectively releasably coupled between at least one of the plurality of hangers 50 and the base 20. The manual locking mechanism can resist motion of the glider frame 30 relative to the base 20 when selectively engaged. The manual locking mechanism can have a lock plate 210, coupled to the base 20, and a plurality of apertures 230 through the lock plate 210. A lock pin 220, shown in FIGS. 2 and 4, can be coupled to one of the plurality of hangers 50 and can engage with the plurality of apertures 230 to restrict movement of the plurality of hangers 50 with respect to the lock plate 210.

In one aspect, the manual locking plate 210 can have two apertures 230. The apertures in the manual locking plate 200 can be strategically located in the manual locking plate 210 to align with the lock pin 220, as shown in FIGS. 2 and 4, so that the glider chair 10 can be manually locked when either occupied or unoccupied. The lock pin can be a spring loaded plunger type pin, as known in the art. Other pin devices, such as a tethered cotter pin and the like, may also be used.

Figure 9:
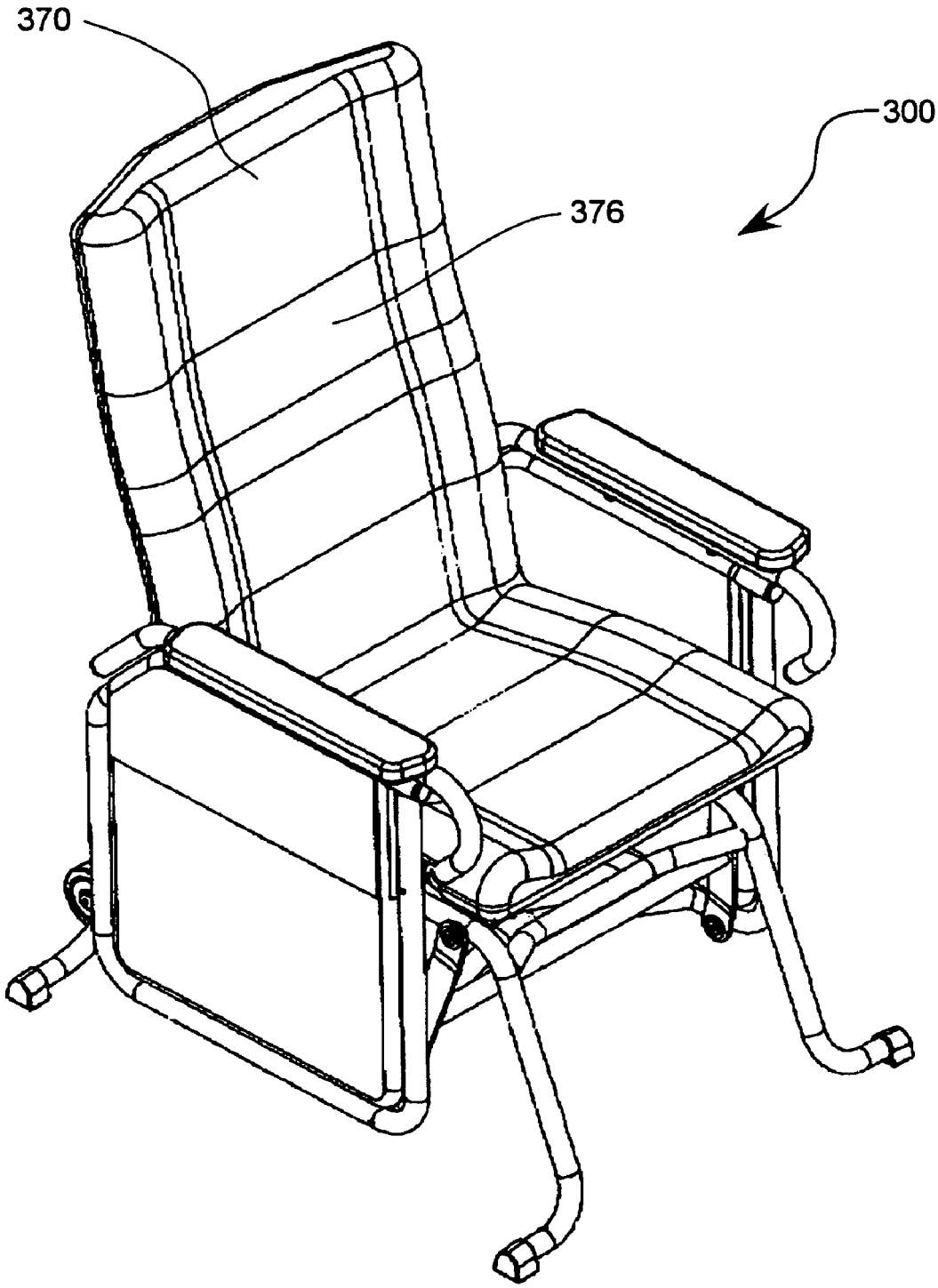
FIG. 9 is a perspective view of a glider chair in accordance with another embodiment of the present invention.

In reference to FIG. 9, illustrated is a perspective view of another embodiment of a glider chair 300 having a cover material 376 attached to the seat 370. The cover material 376 comprises a cloth material, including cushioning. It will be appreciated that other configurations of the cover material can be employed. For example, the cover material could comprise fabric, plastic, wood, or metal and the like, any of which would be suitable for use with the present invention.

It will be also appreciated that, while the glider chair 10 illustrated in FIGS. 1-9 is for a single occupant, other chair configurations, including those that seat multiple occupants, can also benefit from the use of the concepts of the present invention.

The present invention also provides for a method of locking a glider chair against glider motion when an occupant arises from the seat including providing a glider chair having a glider frame and seat swingably suspended by a plurality of hangers from a base disposable on a support surface. The glider frame and seat can swing fore and aft relative to the base. The seat can be biased toward an upper position when unoccupied. An automatic locking mechanism can be engaged between the glider frame and the plurality of hangers when the seat is in the upper position.

It is to be understood that the above-referenced arrangements are only illustrative of the application for the principles of the present invention. Numerous modifications and alternative arrangements can be devised without departing from the scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A glider chair, comprising:

a glider frame and a seat, swingably suspended by a plurality of hangers from a base disposable on a support surface, and swingable fore and aft relative to the base;

the seat being pivotable with respect to the glider frame between an upper position and a lower position, and biased to the upper position;

an automatic locking mechanism, coupled between the seat and at least one of the plurality of hangers, including a linkage coupled to the seat and movable as the seat pivots to engage a toothed bar, coupled to the linkage, with a cross member, coupled to and between two opposite hangers of the plurality of hangers, when the seat is in the upper position, to resist motion of the glider frame relative to the base when the seat is in the upper position, and to disengage the toothed bar from the cross member to allow motion of the glider frame relative to the base when the seat is in the lower position;

a biasing device, moveably coupled between the linkage and the glider frame, and configured to raise the linkage to bias the seat into the upper position; and the linkage, the biasing device and the toothed bar being positioned substantially along a lateral centerline of the chair.

2. A glider chair in accordance with claim 1, wherein the toothed bar includes a plurality of teeth having a nonsymmetrical profile providing at least one notch to receive the cross member and position the glider frame in at least one preferred position with respect to the base.

3. A glider chair in accordance with claim 1, wherein the biasing device is a gas spring cylinder.

4. A glider chair in accordance with claim 1, further comprising:

a manual lock mechanism, selectively releasably coupled between at least one of the plurality of hangers and the base, to resist motion of the glider frame relative to the base when selectively engaged.

5. A glider chair in accordance with claim 4, wherein the manual lock mechanism further comprises:

a lock plate, coupled to the base, and having a plurality of apertures therethrough; and a lock pin, coupled to one of the plurality of hangers, and engageable with the plurality of apertures to restrict movement of the plurality of hangers with respect to the lock plate.

6. A glider chair in accordance with claim 1, further comprising:

a biasing device, coupled between the seat and the glider frame, biasing the seat to the upper position.

7. A glider chair in accordance with claim 6, wherein the biasing device is selected from the group consisting of: a gas spring cylinder, a helical spring, a compression spring, and an elastic band.

8. A glider chair, comprising:

a) a glider frame and seat, swingably suspended by a plurality of hangers from a base disposable on a support surface, and swingable fore and aft relative to the base;

b) the seat being pivotable with respect to the glider frame between an upper position and a lower position, and biased to the upper position;

c) an automatic locking mechanism, coupled between the seat and at least one of the plurality of hangers, and movable as the seat pivots to engage the at least one of the plurality of hangers to resist motion of the glider frame relative to the base when the seat is in the upper position, and to disengage from the at least one of the plurality of hangers to allow motion of the glider frame relative to the base when the seat is in the lower position, the automatic locking mechanism including:

i) a rod, coupled to at least one of the plurality of hangers;

ii) a linkage, extending from the seat;

iii) a biasing device, moveably coupled between the linkage and the glider frame, and configured to raise the linkage to bias the seat into the upper position; and iv) a toothed bar, coupled to the linkage, and engageable with the rod when the seat is in the upper position; and d) the linkage, the biasing device and the toothed bar forming a three-bar linkage positioned substantially along a lateral centerline of the chair.

9. A glider chair in accordance with claim 8, wherein the toothed bar includes a plurality of teeth having a nonsymmetrical profile providing at least one notch to receive the rod and position the glider frame in at least one preferred position with respect to the base.

10. A glider chair in accordance with claim 8, further comprising:

a manual lock mechanism, coupled between the glider frame and the base, engageable to resist motion of the glider frame relative to the base when the seat is in the lower position.

11. A glider chair in accordance with claim 10, wherein the manual lock mechanism further comprises:

a lock plate, coupled to the base, and having a plurality of lock apertures therethrough; and a lock pin, coupled to one of the plurality of hangers, engageable with the plurality of apertures so as to restrict movement of the plurality of hangers with respect to the lock plate.

12. A glider chair in accordance with claim 8, wherein the biasing device is a gas spring cylinder.

13. The glider chair of claim 8, wherein the toothed bar further comprises:

a forward glide limit notch, configured to secure a rod;

a first locking position notch, adjacent the forward glide limit notch;

a second locking position notch, adjacent the first locking position notch;

a rearward glide limit notch, adjacent the second locking position notch; and a rearward sloping tooth, between the first locking position notch and the second locking position notch, and sloping from a greater elevation adjacent the first locking position notch to a lower elevation adjacent the second locking position notch.

* * * * *